US006170217B1

(12) United States Patent
Meyer

(10) Patent No.: US 6,170,217 B1
(45) Date of Patent: Jan. 9, 2001

(54) BEARING ELEMENTS AND METHODS RELATING TO SAME

(76) Inventor: Darrell G. Meyer, 1220 Deerpark #13, Fullerton, CA (US) 92831

( * ) Notice: Under 35 U.S.C. 154(b), the term of this patent shall be extended for 0 days.

(21) Appl. No.: 09/282,306

(22) Filed: Mar. 31, 1999

Related U.S. Application Data

(60) Provisional application No. 60/118,952, filed on Feb. 5, 1999.

(51) Int. Cl.[7] ..... E04C 3/02

(52) U.S. Cl. ..... 52/693; 52/696; 52/729.5; 52/729.1; 52/729.3; 52/653.1; 52/737.1; 52/737.6; 52/731.7; 29/897.35; 29/897.31

(58) Field of Search ..... 52/693, 696, 729.5, 52/737.1, 731.7, 737.6, 729.1, 729.3, 653.1, 702, 650.3; 29/897.35, 897.31

(56) References Cited

U.S. PATENT DOCUMENTS

| | | | | |
|---|---|---|---|---|
| D. 157,994 | | 4/1950 | Palmer . | |
| 693,560 | * | 2/1902 | Molloy | 52/729.5 |
| 1,924,880 | * | 8/1933 | Ragsdale | 189/37 |
| 1,924,881 | * | 8/1933 | Ragsdale | 52/693 |
| 2,007,898 | * | 7/1935 | Ragsdale | 52/693 |
| 2,029,645 | * | 2/1936 | Waugh | 52/696 |
| 2,092,472 | * | 9/1937 | Rafter | 189/37 |
| 2,167,835 | * | 8/1939 | Greulich | 189/40 |
| 2,387,432 | | 10/1945 | DuLaney . | |
| 2,578,465 | | 12/1951 | Davis, Jr. et al. . | |
| 3,129,493 | * | 4/1964 | Grubb | 29/155 |
| 3,221,467 | | 12/1965 | Henkels . | |
| 3,241,285 | * | 3/1966 | Baroni | 52/731 |
| 3,541,749 | | 11/1970 | Troutner . | |
| 3,686,819 | | 8/1972 | Atkinson . | |
| 4,159,604 | | 7/1979 | Burrell . | |
| 4,729,201 | | 3/1988 | Laurus et al. . | |
| 4,793,113 | | 12/1988 | Bodnar . | |
| 5,157,883 | | 10/1992 | Meyer . | |
| 5,499,480 | | 3/1996 | Bass . | |
| 5,553,437 | * | 9/1996 | Navon | 52/731.7 |
| 5,687,538 | | 11/1997 | Frubosilo et al. . | |
| 5,761,873 | * | 6/1998 | Slater | 52/693 |
| 5,771,653 | * | 6/1998 | Dolati et al. | 52/696 |

* cited by examiner

*Primary Examiner*—Beth A. Stephan
*Assistant Examiner*—Dennis L Dorsey
(74) *Attorney, Agent, or Firm*—Fish & Associates, LLP; Robert D. Fish

(57) ABSTRACT

A weight bearing element having a web, and a chord connected to the web, the chord perimeter having a cross-sectional shape of a closed multi-sided figure having at least 5 sides, at least two of which are substantially parallel to the web. Some members may have chords which have a pentagonal cross sectional shape, and/or may include load transferring members or end-caps.

17 Claims, 3 Drawing Sheets

FIG. 5
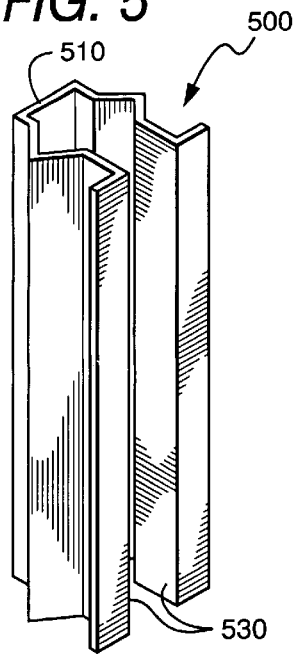
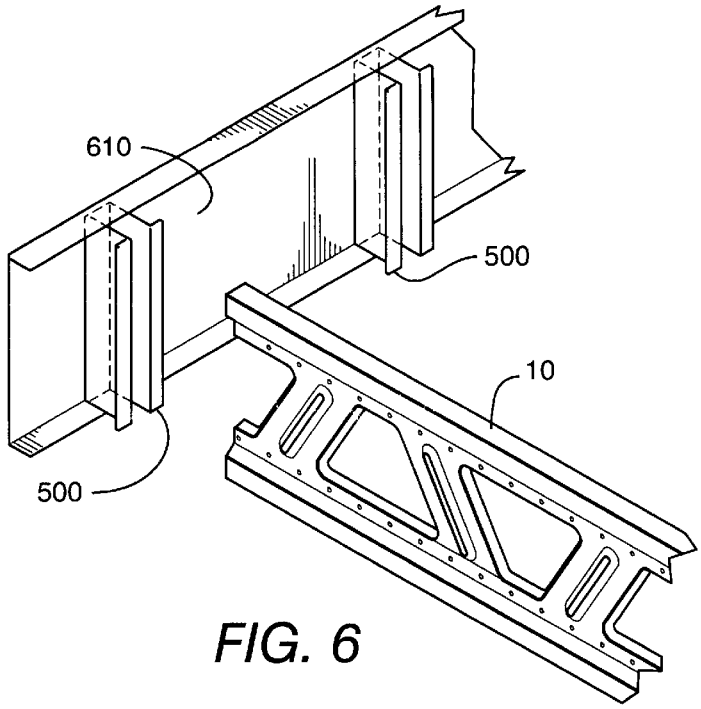
FIG. 6
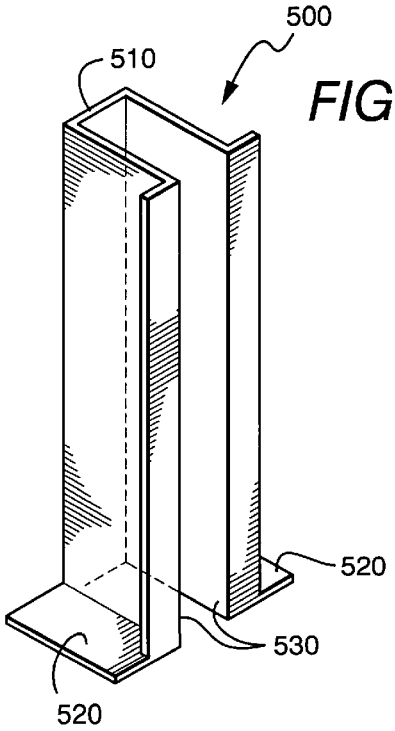
FIG. 7
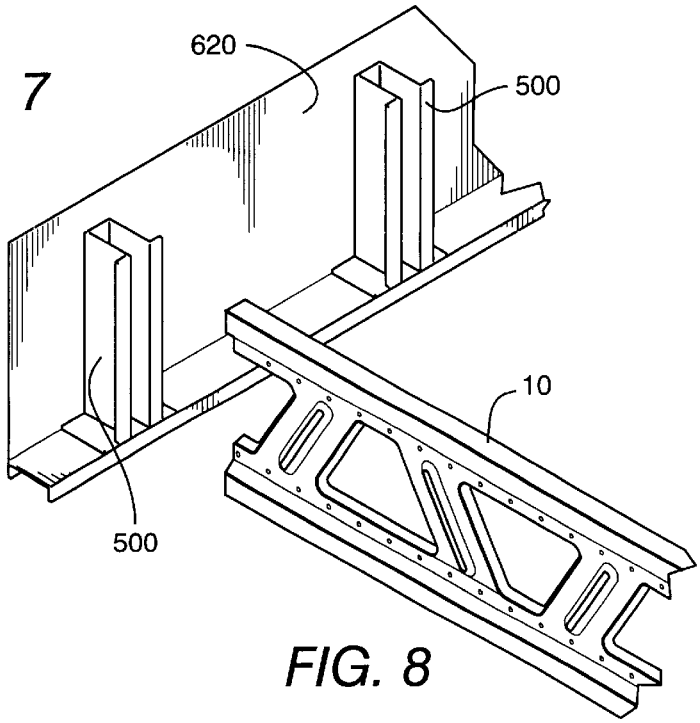
FIG. 8

BEARING ELEMENTS AND METHODS RELATING TO SAME

This application claims the benefit of U.S. provisional application Ser. No. 60/118,952, filed Feb. 5, 1999 incorporated herein by reference in its entirety.

FIELD OF THE INVENTION

The field of the invention is weight bearing elements such as studs and joists.

BACKGROUND OF THE INVENTION

Weight bearing elements are common components in many constructions. For example, floor and ceiling joists function as weight bearing elements and are frequently found in residential and commercial buildings. Although there is a large variety of weight bearing elements, many weight bearing elements are limited in length and weight bearing capacity due to the material(s) from which they are constructed, and are oftentimes difficult to incorporate into constructions because of their structure or cost.

Weight bearing elements can be grouped in two classes, elements predominantly made from wood, and elements predominantly made from metal. Generally, weight bearing elements made from wood are found in older constructions, and were traditionally made from solid saw lumber. However, due in part to a sharp decline in the supply of appropriate solid saw lumber, alternative weight bearing members which use less solid saw lumber were developed. Such alternatives generally comprise two chords (a top, compression chord/member and a bottom, tension chord/member extending the length of the weight bearing element) coupled together by a web (see U.S. Pat. No. 5,664,393 issued on Sep. 9, 1997 to Veilleux et al., U.S. Pat. No. 5,560,177 issued on Oct. 1, 1996 to Brightwell, and U.S. Pat. No. 4,228,631 issued on Oct. 21, 1980 to Geffe). A commonly found alternative is an I-joist having sawn lumber chords or plywood chords. Such an alternative element advantageously reduces the amount of wood required for construction and thereby reduces the weight of the weight bearing element. However, almost all forms of wooden weight bearing elements are relatively heavy when compared to equivalent metal structures. Moreover, wooden weight bearing elements are oftentimes limited to lengths of about less than 24'.

Generally, weight bearing elements made from metal are lighter than comparable wooden elements, may span longer distances and are fireproof. Furthermore, such elements are often available in continuous lengths. Weight bearing elements made from metal are common in various forms, including light gauge steel C-profile joists, trichord open web joists and screw fabricated steel truss joists (see U.S. Pat. No. 5,687,538 issued on Nov. 18, 1997 to Frobosilo et al., U.S. Pat. No. 5,499,480 issued on Mar. 19, 1996 to Bass, U.S. Pat. No. 5,457,927 issued on Oct. 17, 1995 to Pellock et al., U.S. Pat. No. 5,157,883 issued on Oct. 27, 1992 to Meyer, U.S. Pat. No. 4,793,113 issued on Dec. 27, 1988 to Bodnar, U.S. Pat. No. 4,729,201 issued on Mar. 8, 1988 to Laurus et al., U.S. Pat. No. 4,159,604 issued on Jul. 3, 1979 to Burrell, U.S. Pat. No. 3,686,819 issued on Aug. 29, 1972 to Atkinson, U.S. Pat. No. 3,541,749 issued on Nov. 24, 1970 to Troutner, U.S. Pat. No. 3,221,467 issued on Dec. 7, 1965 to Henkels, U.S. Pat. No. 2,578,465 issued on Dec. 11, 1951 to Davis, Jr. et al., U.S. Pat. No. 2,387,432 issued on Oct. 23, 1945 to Laney, and U.S. Pat. No. 157,994 issued on Apr. 4, 1950 to Palmer).

Light gauge steel C-profile joists may be manufactured from roll-formed galvanized steel. However, in order to achieve appropriate rigidity, light gauge steel C-profile joists are oftentimes made from 16-gauge steel, which tends to be more difficult to drill or perforate. Furthermore, additional elements are oftentimes difficult to attach to light gauge steel C-profile joists.

Trichord open web joists are generally more rigid than light gauge steel with C-profile but often have to be custom manufactured to fit span, load, etc. A further common disadvantage of trichord open web joists is that they are difficult to attach or to join with hangers.

Screw fabricated steel truss joists often suffer from 4 common drawbacks: They are labor-intensive, expensive in manufacturing, have to be custom made and tend to loosening of screws leading to impaired stability and additional wear.

Thus, there is still a need for improved weight bearing elements and methods to produce improved weight bearing elements.

SUMMARY OF THE INVENTION

The present invention is directed to improved weight bearing elements and methods relating to same. Such elements are contemplated as having a web, and a chord connected to the web, the chord perimeter having a cross-sectional shape of a closed multi-sided figure having at least 5 sides, at least two of which are substantially parallel to the web. Some members may have chords which have a pentagonal cross sectional shape, and/or may include load transferring members or end-caps.

In some embodiments, the weight bearing elements disclosed herein may be "roll-formed" from a continuous sheet of material such as light gauge galvanized steel. In other embodiments, they may exhibit one or more of the following feature: improved load bearing capacity; lighter weight; reduced material usage; easier to manufacture and/or install; able to be cut to custom lengths.

Although joists are only a subset of the weight bearing elements to which the disclosed subject matter applies, the term "joist" will be used frequently hereafter to refer to all weight bearing elements in order to make this disclosure easier to read. The term polygonal as used herein includes figures in which the bounding line segments are joined by curves as well as more traditional "angular" figures.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 5 is a perspective view of a back-mounted end cap.

FIG. 6 is a perspective view of a joist being connected to a "track" type support via a back mounted end-cap.

FIG. 7 is a perspective view of a back and bottom mounted endcap.

FIG. 8 is a perspective view of the endcap of FIG. 7 being used to connect a joist to a "rail" type support via a back and bottom mounted endcap

DETAILED DESCRIPTION

Figure 2:
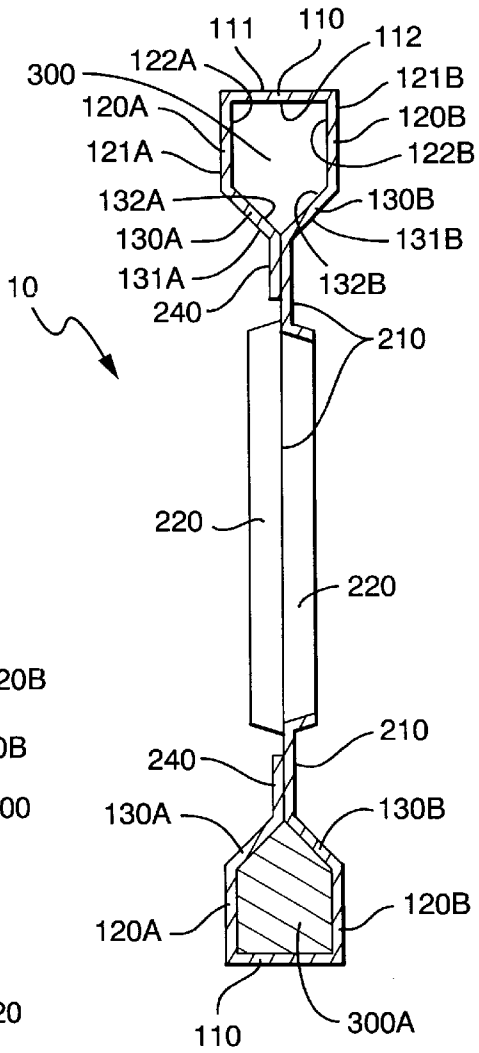
FIG. 2 is a cross-sectional view of the joist of FIG. 1.
Figure 1:
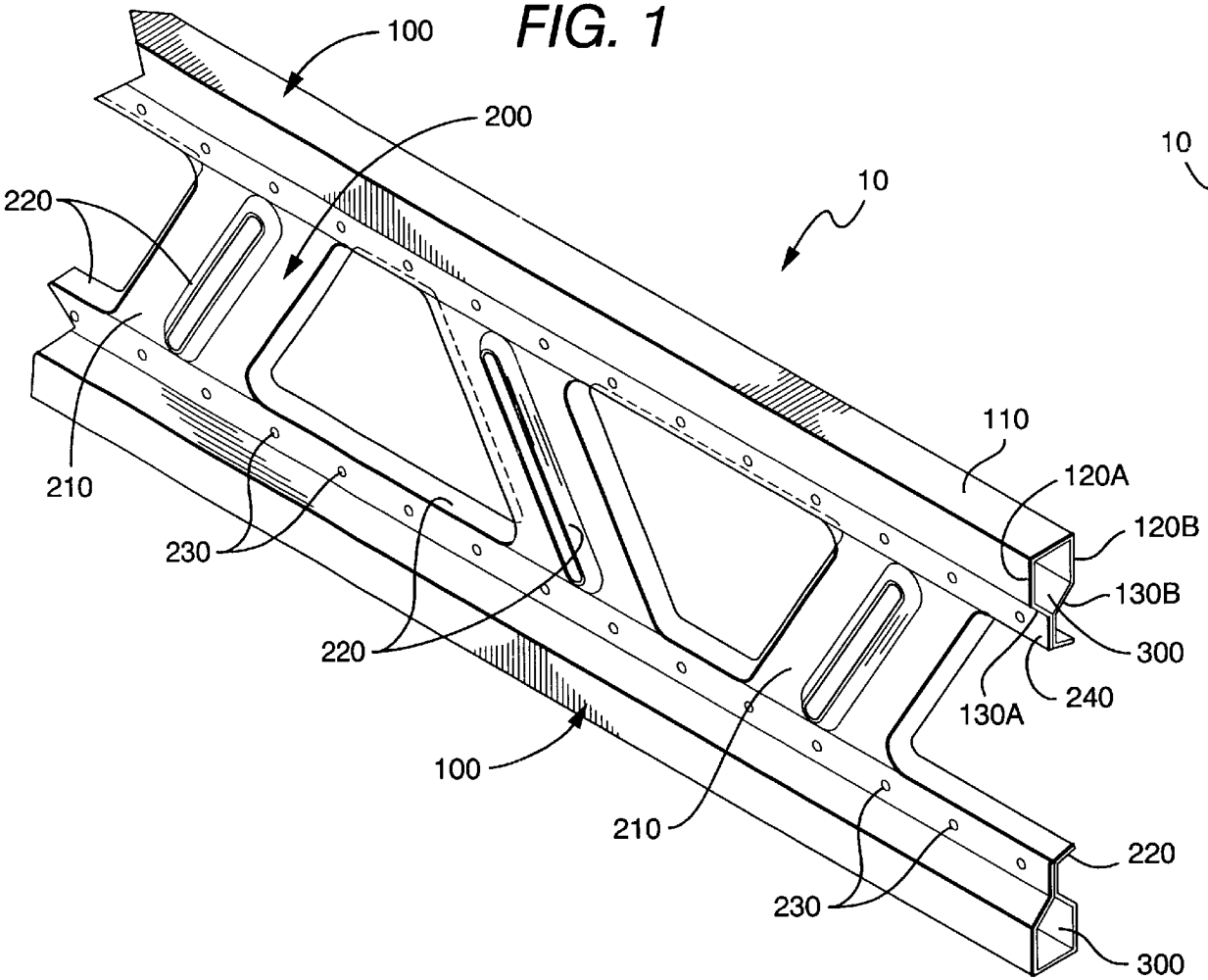
FIG. 1 is a perspective view of a joist embodying the invention.

Referring to FIGS. 1 and 2, a preferred weight bearing element/joist 10 comprises top/tension and bottom/compression chords 100 and web 200. Chords 100 comprise a top supporting side 110, a left supporting side 120A, a right supporting side 120B, and left and right transition sides 130A, and 130B. Web 200 comprises body 210, flanges 220, fasteners 230, and chord lips 240. Referring to FIG. 2, the perimeters of chords 100 of joist 10 can be seen to have a polygonal cross sectional shape having 5 sides, at least two of which are substantially parallel to the web.

In preferred embodiments, supporting side 110 couples the two parallel sides 120A and 120B to each other and provides a load bearing surface. Sides 120A and 120B are substantially parallel to each other and to the body 210 of web 200. Sides 110, 120A, 120B, 130A and 130B can be seen to be planar and to compose parts, via their exterior surfaces 111, 121A, 121B, 131A, and 131B, of the perimeter surface of the chord and to define a cavity 300 via their interior surfaces 112, 122A, 122B, 132A, and 132B, which are not part of the perimeter surface of the chord. Thus, cavity 300 is adjacent to and partially forms a cavity located within the perimeter surface of the chord. Chords 100 are generally parallel to each other, and the cavities 300 contained within them extends the length of the chords 100.

In joist/weight bearing element 10, the 5 planar sides 111, 121A, 121B, 131A, and 131B can referred in a number of ways. It is contemplated that referring to side 111 as the top mounting surface of chord 10, side 121A as the left mounting surface of chord 10, side 121B as the right mounting surface of chord 10, side 131A as the left transition surface of chord 10, and side 131B as the right transition surface of chord 10 may be beneficial. Using such terms to distinguish between the sides, it can be seen that joist 10 and its sides have the following features: the left side mounting surface 121A and the right side mounting surface 121B are each substantially parallel to body 210 of web 200; the top mounting surface 111 is substantially perpendicular to the web body 210; the left side mounting surface 121A, the right side mounting surface 121B, the left transition surface 131A, and the right transition surface 131B each comprise a top edge and a bottom edge with the top edge of each of the left side mounting surface 121A and right side mounting surface 121B being coupled to the top mounting surface 111, the bottom edge of the left side mounting surface 121A being coupled to the top edge 111 of the left transition surface 131A, and the bottom edge of the right side mounting surface 121B being coupled to the top edge of the right transition surface 131B; the left and right transition surfaces 131A and 131B extend away from all of the top mounting surface 111, the left mounting surface 121A, and the right mounting surface 121B; and the bottom edge of each of the left transition surface 131 A and right transition surface 131B are coupled to the web 200.

It is contemplated that alternative embodiments of weight bearing elements may have A planar sides where A is one of 6, 7, 8, 9, 10, 11, 12, 13, 14, 15, or A is greater than 15.

Because chords 100 comprise planar, i.e. relatively flat and thin, sides connected together, it is possible to form chords 100 from a sheet of thin material such as galvanized steel by simply bending the material into the pentagon shape of the chords 100. It is contemplated that alternative embodiments may utilize various gauges of steel including, but not necessarily limited to 18 gauge and 20 gauge. It is also contemplated that alternative embodiments of weight bearing elements may have sides which are less than N inches thick where N is one of 1, 0.75, 0.5, 0.25, 0.125, and 0.1.

The cavity 300 within one or more of chords 100 may be filled with a material 300A so as to increase the weight or modify the weight distribution of the joist/weight bearing element 10. Thus, some embodiments may be ballast (from top to bottom) weighted as in a floor joist, or a drag (from bottom to top) weighted as in a ceiling joist. The material or materials used may be uniform throughout the cavity or may comprise separate elements located within the cavity 300. The materials used may also be used to modify other features of the joist other than weight including, but not limited to, buoyancy and rigidity.

Web 200 is preferred to be formed from the same sheet of material as chords 100. It is also preferred that web 200 be "open" in the sense that portions of the web body 210 are removed, preferably by punching, to create the pattern shown in FIGS. 1 and 2, as well as to form flanges 220. Web 200 is also preferred to comprise fasteners 230 for fastening chord lips 240 to body 210.

Figure 3:
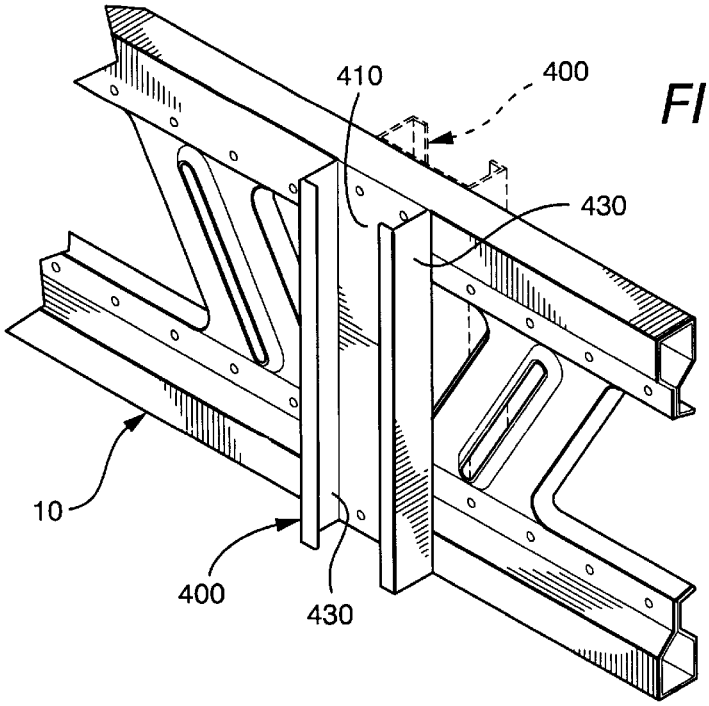
FIG. 3 is a perspective view of a joist and load transfer member combination embodying the invention.
Figure 4:
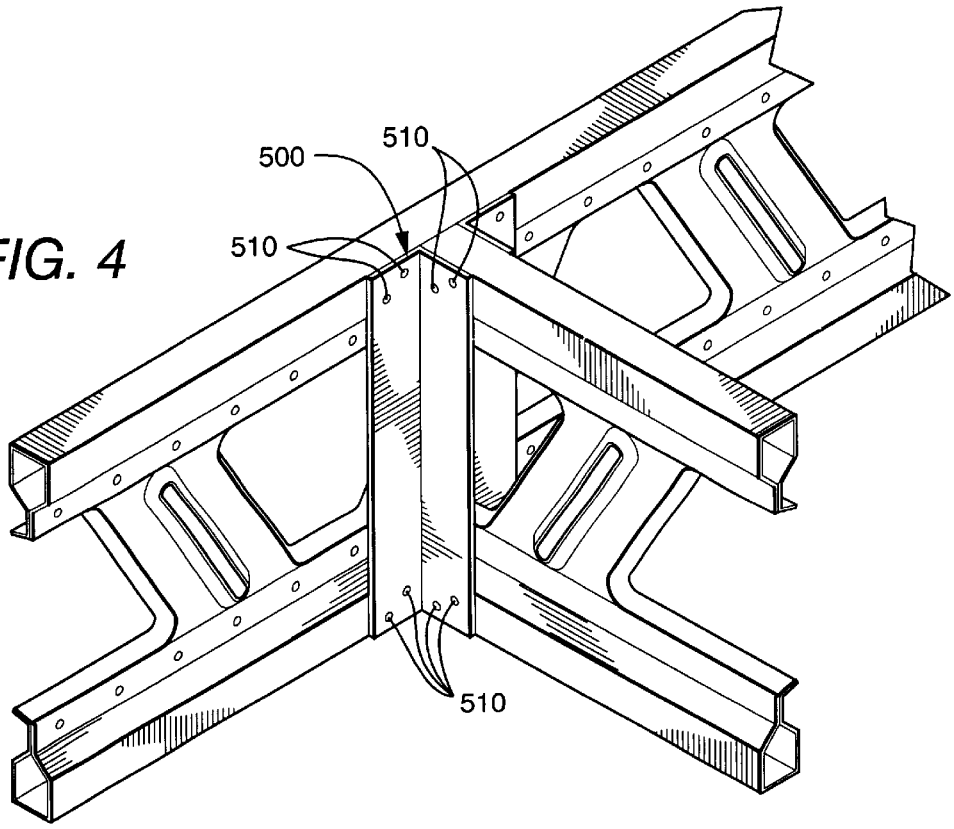
FIG. 4 is a perspective view of a joist and end cap combination embodying the invention.

It is also contemplated that joists 10 may be used in combination with load transferring studs 400 as shown in FIG. 3, or couplers 500 as shown in FIGS. 4–8. Load transfer studs may be comprised of flat plates and/or more 3-dimensional shapes such as that shown in load transfer stud 400 of FIG. 3. The size and dimensions of various embodiments of transfer studs 400 may vary, as may the method and materials used to form them, so long as they serve to transfer load forces from one chord to another so as to lessen the load on web 200. Couplers 500 can be used to couple joist 10 to a second joist or to some other object. It is contemplated that in some embodiments, a particular device may function as both a load transfer stud 400 and a coupler 500. As with transfer studs 400, the size and dimensions of various embodiments of couplers 500 may vary, as may the method and materials used to form them, so long as they serve to couple ajoist 10 to a second joist or another object. Transfer studs 400 and couplers 500 may also vary as to the manner in and/or location at which they are coupled to joist 10. Some embodiments may thus attach at the ends using screws, while others may be coupled to a non-end portion of the joist, may be fastened by welding or some other means, and may be coupled to one or more sides of chords 100 or to a portion of web 200. Various methods of using transfer studs 400 and couplers 500 are pictured in FIGS. 3–8.

It should be noted that the use of parallel sides 120A and 120B on chords 100 provide a flat surface to which sides 430 of transfer studs 400 and sides 530 couplers 500 can be attached. It is contemplated that some embodiments will include pre-drilled holes in chords 100 and in the back 410 and sides 430 transfer studs 400, and in the back 510 and sides 530 of couplers 500 to facilitate the fastening of such studs 400 and couplers 500 to joists 10 via chords 100 through the use of screws or other fasteners.

Referring to FIGS. 5–8, alternative forms of couplers/end caps 500 are shown. It is contemplated that an end cap 500 such as that of FIG. 5 is particularly suitable for mounting via sides 530 to a joist 10 and via back 510 to another support such as a joist 10 or the track support 610 of FIG. 6. It is also contemplated that an end cap 500 such as that of FIG. 6, because it comprises flanges 520, will be particularly suitable for mounting to a rail support 620 of FIG. 8.

It is contemplated that weight bearing elements according to the subject matter disclosed herein may vary greatly in size. Thus smaller weight bearing elements may be used in, among others, prosthetic devices including but not limited to dental implants covering multiple teeth and long bone replacements, household utensils, cars, small planes, scaffolding, and furniture. Larger elements may be used in, among others, bridges, oil tankers, large planes, and light-weight ladders.

It is contemplated that various embodiments of the weight bearing elements disclosed herein may be formed from one or more materials. Such materials may include, but are not necessarily limited to: a metal such as stainless steel, aluminum, galvanized steel, and iron; polymers such as PVC, thermoplastic, inflexible polyethylene, and polycarbonate, polypropylene, and polyethylene (such polymers may be provided in granules, in an unpolymerized for, and/or in sheets of flexible polymers); fibrous man-made material including, but not limited to, glass-/carbon fibers hardened with resins; and elemental metals including magnesium.

It is contemplated that weight bearing elements according to the subject matter disclosed herein may be formed in a number of methods involving steps which include, but not limited to: preforming such as by rolling from a coil and/or plates of precut lengths; and preprocessing such as by coating, cutting, and/or punching.

One method of forming a weight bearing element/support member 10 according to the claimed subject matter might simply involve roll forming a sheet of metal into the shape shown in FIGS. 1 and 2 by bending each side of the sheet six times so as to form a pentagonal chord 100 and chord lip 240, and then fastening, possibly through the use of adhesives, screws, welding, or a clench press, chord lip 240 to body 210. Such a method could also include a step of punching out portions of body 210 so as to form a web pattern and flanges 220 as shown in the figures.

Another method involves the use of polymers which may be deformed from a sheet into a pentagonal shape and then fixed by heat and/or glue. Similarly, granules or unpolymerized material may be filled into a mold and symmetrical portions cast with such portion then being fixed together by heat, ultrasound, glue, etceteras. In yet another example, a fibrous man-made material is wrapped around templates to create a first, immature form, which will be modified into a second, mature form by applying resin or other polymer to harden the fiber mats. In yet one more example magnesium may be poured into a mold to obtain a first, immature form of the product which will then be fixed by heat to form a second, mature form.

Thus, specific embodiments and applications of weight bearing elements have been disclosed. It should be apparent, however, to those skilled in the art that many more modifications besides those already described are possible without departing from the inventive concepts herein.

What is claimed is:

1. A weight bearing element comprising a substantially flat web; and at least one chord defining a perimeter having a polygonal cross-sectional shape with at least 5 mutually non-coplanar sides, at least two of the sides are substantially parallel to the web, and the chord coupled to the web at at least one vertex of an angle of the chord.

2. The weight bearing element of claim 1 wherein the cross section of the at least one chord, excluding any portion in parallel with and connected to the web, has a shape of a regular or irregular pentagon, the chord being connected to the web at the vertex of one angle of the pentagon.

3. The weight bearing element of claim 1 further comprising a fill material in the cavity of at least one of the at least one chord.

4. The weight bearing element of claim 1 wherein the at least one chord consists of two substantially parallel chords coupled to opposite sides of the web.

5. The weight bearing element of claim 4 wherein the chord further comprises at least 5 planar sides, each side corresponding to one side of the closed multi-sided figure of the cross-sectional shape of the chord.

6. The weight bearing element of claim 5 wherein the number of sides is at least 6.

7. The weight bearing element of claim 5 wherein each of the at least 5 planar sides is less than N inches thick where N is one of 1, 0.75, 0.5, 0.25, 0.125, and 0.1.

8. The weight bearing element of claim 5 wherein each of the at least 5 planar sides comprises X gauge steel where X is one of 20 and 18.

9. The weight bearing element of claim 5 formed by roll forming a single sheet of material into the web and at least one chord.

10. The weight bearing element of claim 5 wherein the exterior surface of one of the at least 5 planar sides is a top mounting surface;

the exterior surface of one of the at least 5 planar sides is a left side mounting surface;

the exterior surface of one of the at least 5 planar sides is a right side mounting surface;

the exterior surface of one of the at least 5 planar sides is a left transition surface; and the exterior surface of one of the at least 5 planar sides is a right transition surface;

wherein the left side mounting surface and the right side mounting surface are each substantially parallel to the web;

the top mounting surface is substantially perpendicular to the web;

the left side mounting surface, the right side mounting surface, the left transition surface, and the right transition surface each comprise a top edge and a bottom edge;

the top edge of each of the left side mounting surface and right side mounting surface are coupled to the top mounting surface;

the bottom edge of the left side mounting surface is coupled to the top edge of the left transition surface, and the bottom edge of the right side mounting surface is coupled to the top edge of the right transition surface;

the left and right transition surfaces extend away from all of the top mounting surface, the left mounting surface, and the right mounting surface; and the bottom edge of each of the left transition surface and right transition surface is coupled to the web.

11. The weight bearing element of claim 10 comprising at least two chords and at least one load transfer member coupled to and extending between the at least two chords, the load transfer member having a back and two sides, wherein the back is mounted flush to either the left or the right side mounting surfaces of the at least two chords, and the two sides of the load transfer member extend outward from the back and the side mounting surfaces of the chords.

12. The weight bearing element of claim 10 comprising at least two chords and at least one end cap coupled to and extending between the at least two chords, the end cap having a back and two sides, wherein a first side of the two sides of the end cap is mounted flush to the left side mounting surface of the at least two chords, a second side of the two sides of the end cap is mounted flush to the right side mounting surface of the at least two chords, and the back connects and extends between the two sides of the end cap such that the end cap, if the back were mounted to an external support, would transfer a load placed on the weight bearing element to the external support.

13. The weight bearing elmenmt of claim 1 wherein the chord is fabricated from a single continuous sheet.

14. The weight bearing element of claim 1 wherein the polygonal cross-sectional has five sides.

15. The weight bearing element of claim 1 wherein the chord has a height and a width, such that the height is greater than the width.

16. The weight bearing element of claim 1 wherein the web includes a plurality of openings having flanges formed in a trapezoidal pattern.

17. The weight bearing element of claim 16 wherein the web includes a plurality of punched out openings having flanges formed in a trapezoidal pattern.

* * * * *